US006389147B1

(12) United States Patent
Rush et al.

(10) Patent No.: US 6,389,147 B1
(45) Date of Patent: May 14, 2002

(54) AUDIO SYSTEM FOR MULTIPURPOSE AUTOMOTIVE VEHICLES HAVING A REAR OPENING PANEL

(75) Inventors: Scott Anthony Rush, Livona; Robert Anthony Bordo, Macomb County, both of MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/740,571

(22) Filed: Dec. 18, 2000

(51) Int. Cl.[7] ..... H04R 1/02

(52) U.S. Cl. ..... 381/389; 381/86; 381/302; 381/386

(58) Field of Search ..... 381/300, 302, 381/304, 334, 86, 87, 71.4, 386, 389, 182, FOR 151, FOR 165

(56) References Cited

U.S. PATENT DOCUMENTS 4,451,928 A * 5/1984 Murayama ..... 381/389
4,759,066 A * 7/1988 Polk et al. ..... 381/86
4,866,776 A * 9/1989 Kasai et al. ..... 381/86

* cited by examiner

*Primary Examiner*—Huyen Le
(74) *Attorney, Agent, or Firm*—Laura C. Hargitt

(57) ABSTRACT

An audio system for projecting sound toward a rear opening of an automotive vehicle is disclosed. Each side of the vehicle includes a speaker assembly mounted to a side interior wall between a side door and the rear opening of the vehicle. The assemblies each include a speaker housing containing a forwardly disposed speaker cone with an axis generally perpendicular to the vehicle side and a rearwardly disposed speaker cone with an axis disposed toward the rear opening at an angle of about 15 degrees relative to the forwardly disposed speaker cone axis. An audio transmitter is in signaling communication with each of the speaker cones for driving the speaker cones.

11 Claims, 5 Drawing Sheets

AUDIO SYSTEM FOR MULTIPURPOSE AUTOMOTIVE VEHICLES HAVING A REAR OPENING PANEL

TECHNICAL FIELD

The present invention relates to an automotive vehicle audio system for improved sound projection toward a rear opening of the vehicle.

BACKGROUND OF THE INVENTION

Recent technological developments have enhanced the popularity of multi-purpose automotive vehicles such as minivans or sport-utility vehicles. In general, these vehicles share the common features of a single cabin having a forward passenger portion integrated with an adjoining rear cargo portion. Access to the rear cargo portion is provided through a rear opening in the cabin, which is typically sealed by a hinged panel or door.

It is desirable for a multipurpose vehicle to support a wide variety of lifestyles. To this end, it is becoming more desirable to use a multipurpose vehicle for furnishing sound outside of the vehicle, such as while camping, at picnics, or other such events. Typically, however, automotive vehicle sound systems are designed for containing sound volume within the vehicle cabin and include inwardly aimed speakers. To project sound outside a stationary vehicle, the volume must be raised to high levels, which will distort the sound or drain battery power.

It is desirable in a multipurpose automotive vehicle to provide a sound system that efficiently projects high quality sound through the vehicle's rear opening when the rear panel is open, and also delivers rich sound quality within the cabin of the vehicle when the rear panel is open or closed.

SUMMARY OF THE INVENTION

According to the invention, there is disclosed an audio system for projecting sound toward a rear portion of an automotive vehicle having a body with a first side and a second side, each being spaced opposite the other about a longitudinal axis of the body, and a rear opening. At least one side door on each side of said body is provided, along with at least one panel hingedly connected to the body for permitting passage through and sealing the rear opening.

A first speaker assembly is mounted to an interior wall on the first side between the side door in the first side and the rear opening. The assembly includes a first speaker housing containing a first forwardly disposed speaker cone with an axis generally perpendicular to the first side and a first rearwardly disposed speaker cone with an axis disposed toward the rear opening at an angle of about 15 degrees relative to the first forwardly disposed speaker cone axis.

A second speaker assembly is mounted to an interior wall on the second side between the side door on the second side and the rear opening, and opposite the first speaker assembly. The second speaker assembly includes a second speaker housing containing a second forwardly disposed speaker cone with an axis generally perpendicular to the second side and a second rearwardly disposed speaker cone with an axis disposed toward the rear opening at an angle of about 15 degrees relative to the second forwardly disposed speaker cone axis.

An audio transmitter is in signaling communication with each of the speaker cones for driving the speaker cones.

BRIEF DESCRIPTION OF THE DRAWINGS

These and other objects, features and advantages of the invention will become apparent upon consideration of the specification and the appended drawings in which:

FIG. 1(*b*) illustrates an overhead view of a section of the automotive vehicle of FIG. 1(*a*).

FIG. 2(*b*) illustrates an overhead view of a section of the automotive vehicle of FIG. 2(*a*).

DESCRIPTION OF THE PREFERRED EMBODIMENT

Figure 1A:
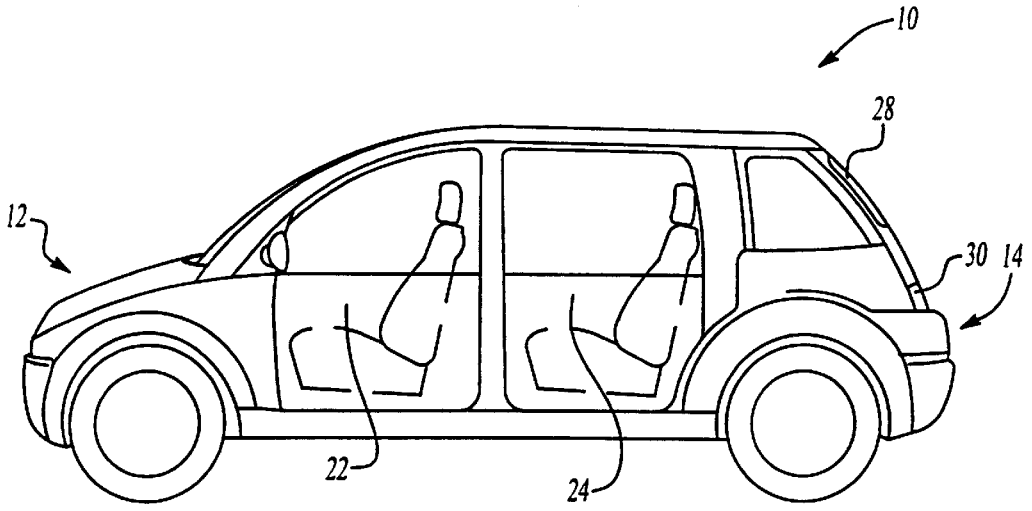
FIG. 1(*a*) illustrates a side view of one illustrative automotive vehicle having a closed rear opening, rear panels and an audio system.
Figure 1B:
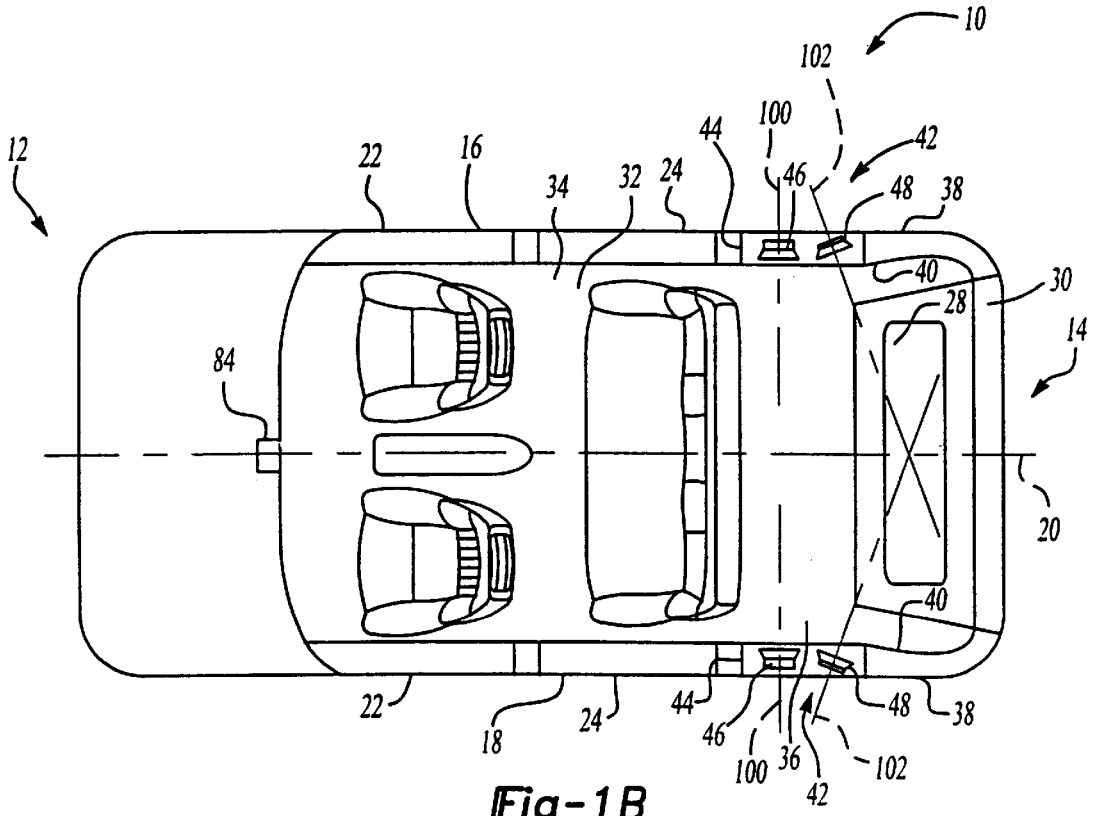
Figure 2A:
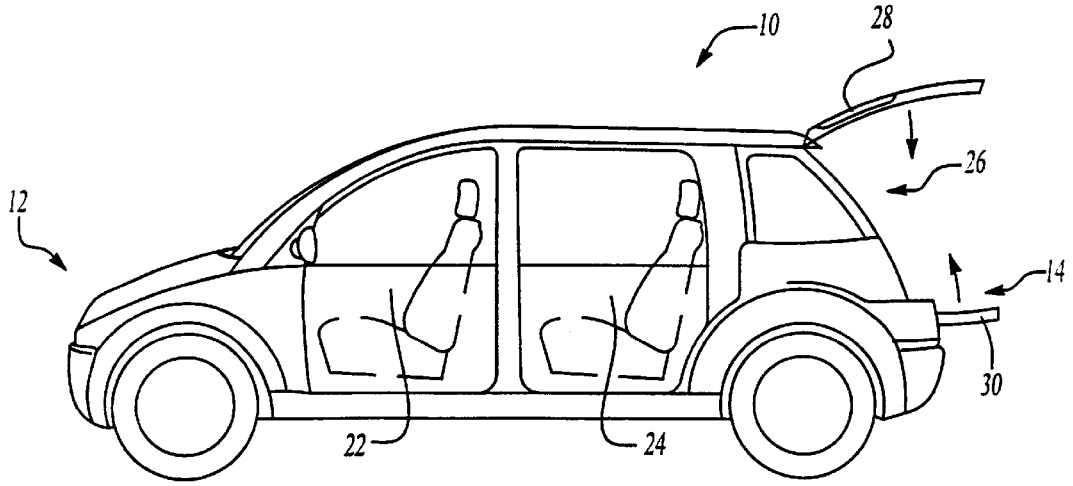
FIG. 2(*a*) illustrates another side view of the automotive vehicle in FIGS. 1(*a*) and 1(*b*) having the rear panels in an open position.
Figure 2B:
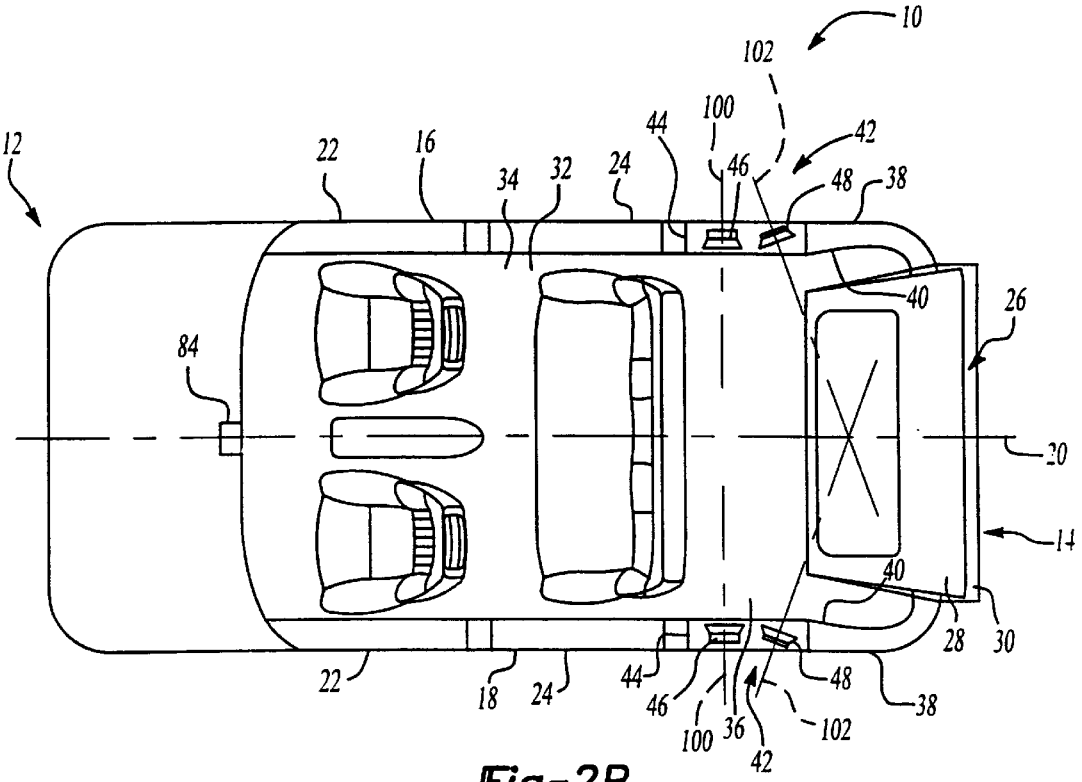

Referring to FIGS. 1(*a*), 1(*b*), 2(*a*) and 2(*b*), there is illustrated a multipurpose vehicle 10 having an audio system with rearwardly angled speakers of the present invention. The vehicle 10 has a front end 12, a rear end 14 and a first side 16 spaced opposite a second side 18 about a longitudinal axis 20. The first side 16 and the second side 18 each include a front 22 door and a rear door 24. The rear end 14 includes an opening 26 that can be sealed, as in FIGS. 1(*a*) and 1(*b*), with a panel assembly including an upper rear panel 28 having a window, the upper rear panel 28 hingedly connected at its top to the vehicle body, and a lower rear panel 30 hingedly connected at its bottom to the vehicle body. The free ends of the upper rear panel 28 and lower rear panel 30 sealingly engage one another when the panels 28, 30 are in their closed position.

The interior of the vehicle 10 includes a cabin 32, including a forward passenger portion 34 having seats and a rearward cargo portion 36. On each side of the cargo portion 36, disposed between an exterior body panel 38 and at least one interior trim panel 40, there is a speaker assembly 42 including a housing 44 that substantially encloses a first transversely disposed speaker 46 and a second rearwardly angled speaker 48.

Figure 3:
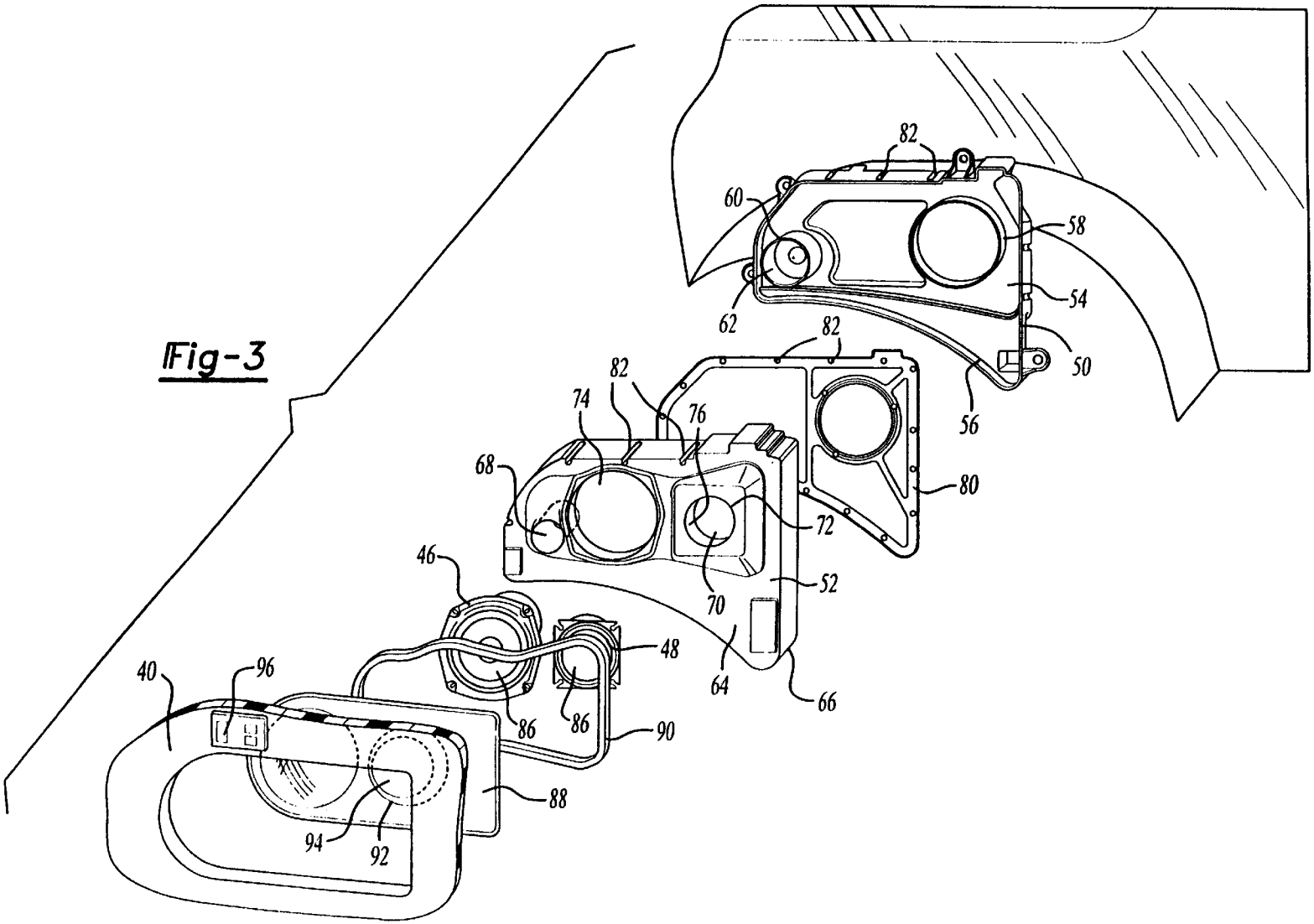
FIG. 3 is an exploded perspective view of a speaker assembly of this invention.
Figure 4:
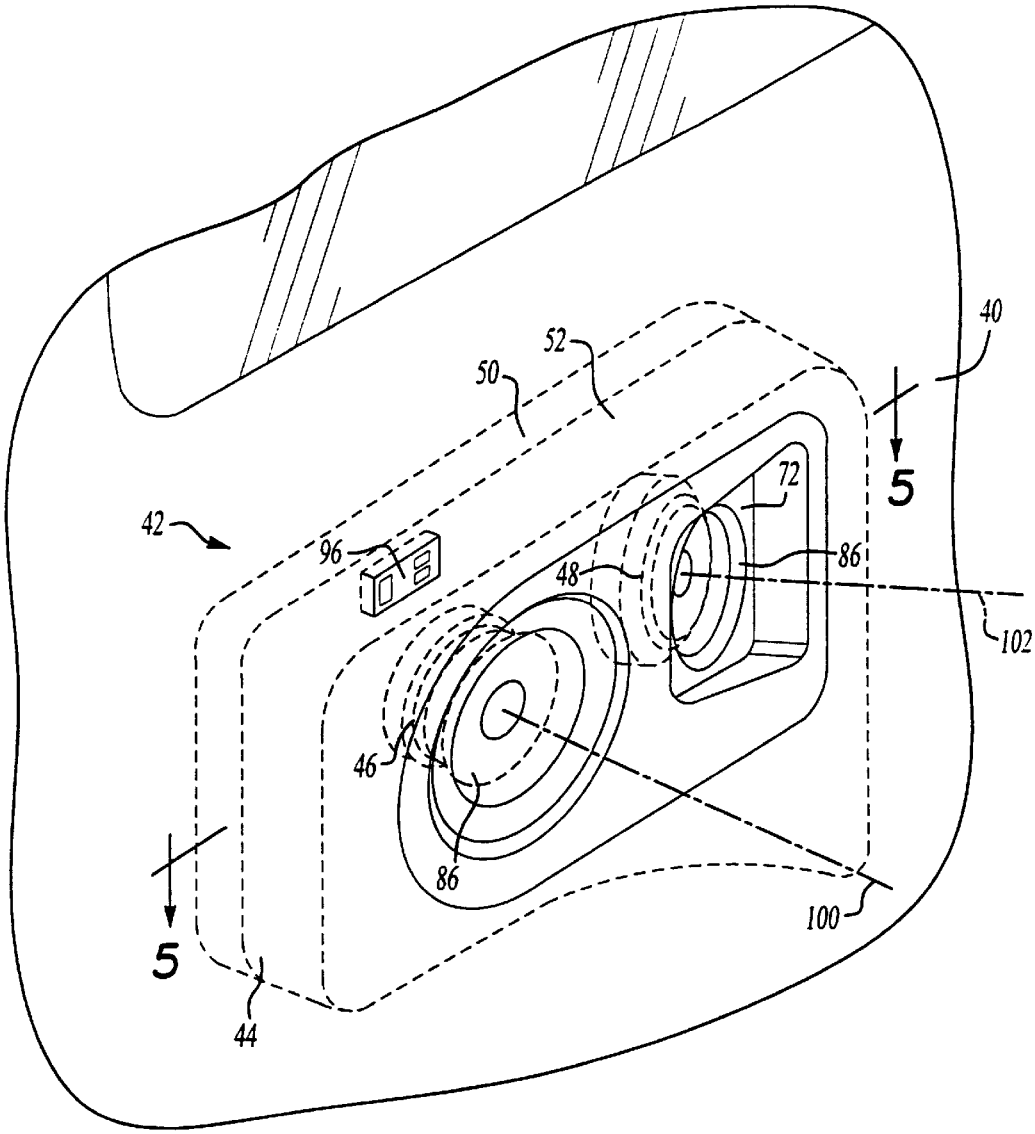
FIG. 4 is another perspective view of the speaker assembly.
Figure 5:
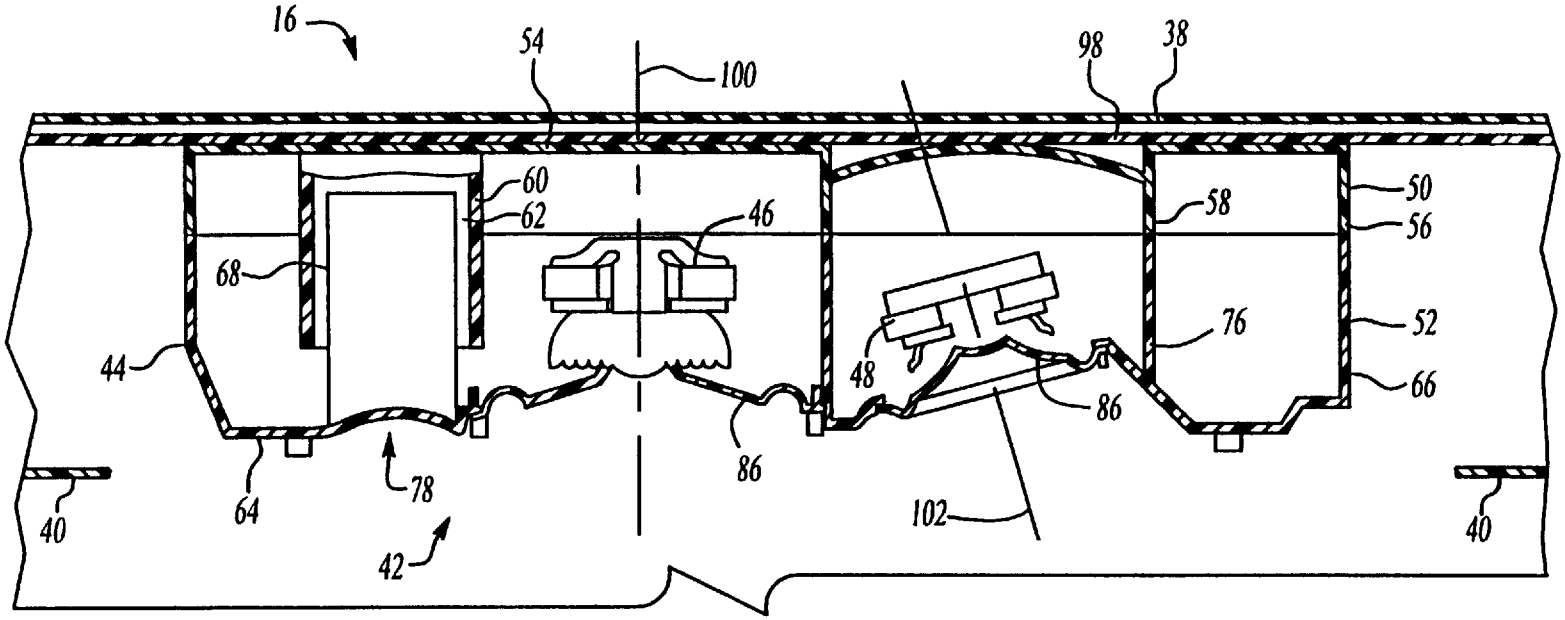
FIG. 5 is a sectional view of the speaker assembly taken along line 5—5 of FIG. 4.

Referring to FIGS. 3–5, the housing 44 is adapted for placement over a vehicle wheel well, and includes a first molded plastic shell portion 50 for engaging a second molded plastic shell portion 52 and enclosing the speakers 46, 48. The first shell portion 50 includes a base wall 54 with a first projecting side wall 56 substantially about its perimeter. The base wall 54 also includes a first rearward annular wall 58 dimensioned for receiving and enclosing the rear speaker 48. The first shell portion 50 also includes a first forward annular wall 60 extending away from the base wall 54 thereby forming a cavity 62. A plurality of baffles may be included as desired for tuning sound quality.

The second shell portion 52 includes a forward wall 64 and a second projecting side wall 66 substantially about its perimeter, with the first projecting side wall 56 and the second projecting side wall 66 substantially mirroring one another. The forward wall 64 of the second shell portion 52 includes a second forward annular wall 68, a rearward speaker aperture 70 defined in a sloping wall portion 72 and a forward speaker aperture 74. Positioned on the other side of the sloping wall portion 72 is a second rearward annular wall 76 having substantially a mirror wall shape as the first rearward annular wall 58. Upon joining the first rearward annular wall 58 with the second rearward annular wall 76, as seen in FIG. 5, a speaker enclosure is defined for the rearward speaker 48, physically separating it from the enclosure for the forward speaker 46. Furthermore, the second forward annular wall 68 is received in the cavity 62 formed by the first forward annular wall 60 wherein the outer periphery of the second forward annular wall 68 is spaced apart from both an inner surface of the first forward annular wall 60 and from the base wall 54 of the first shell portion 50, thus defining an acoustical port 78.

The housing 44 is assembled by placing the side wall 56 of the first shell 50, an intermediate plastic gasket 80 and the side wall 66 of the second shell 52 into opposing contact with each other. Corresponding fastener apertures 82, defined through the gasket 80 and in each of the shells 50, 52, are aligned and a fastener inserted to join them together.

The forward speaker 46 is secured within the forward aperture 74 of the housing 44, and the rearward speaker 48 is secured within the rearward aperture 70 of the housing 44. Each of the speakers 46, 48 are connected in signaling communication with an audio transmitter 84 for driving respective speaker cones 86 of the speakers 46, 48.

Referring to FIG. 3, the interior trim 40 for an automotive vehicle employing the system of the present invention includes a grille cover 88 that is placed over the speakers 46, 48 with a foam gasket 90 between the grille 88 and the second shell portion 52. The grille 88 includes a frusto-conical wall 92 attached to a circular sloping portion 94, which corresponds to or aligns with the sloping portion 72 of the housings 44. An interior trim panel 40, which may have a remote control switch 96 mounted on it, is placed over the assembly.

Each speaker assembly 42 thus is mounted to an interior wall 98 of one of the vehicle's sides 16, 18, between a rear side door 24 and the rear opening 26. The assemblies 42 thus include speaker housings 44 each containing a forwardly disposed speaker cone 86 with an axis 100 generally perpendicular to one of the vehicle sides 16, 18 and a rearwardly disposed speaker cone 86 with an axis 102 disposed toward said rear opening 26 at an angle of about 15 degrees relative to the forwardly disposed speaker cone axis 100 or about 75 degrees with respect to the sides 16, 18 of the vehicle 10 or the central longitudinal axis 20.

As will be appreciated from the above, by virtue of the positioning of the speakers, as facilitated through the unique housing of the present invention, a multitude of direct sound waves can be delivered out of the entire or nearly the entire rear opening of a multipurpose vehicle having at least one rear panel in its open position thereby providing improved sound outside of the rear of the vehicle. Furthermore, off-axis sound waves from the speakers will reflect off the side glass and interior trim in the cabin of the vehicle to deliver reflected sound waves through the rear opening in combination with the direct sound waves, further enhancing perceived sound output outside the vehicle. When the rear panel is closed, in view of the wide off-axis response of the speakers and the angular disposition, the speakers continue to provide high quality sound within the cabin of the vehicle by providing both attenuated direct sound waves and sound waves reflected off the windows and interior of the vehicle to both the passenger and storage compartments of the vehicle.

The person of skill in the art shall recognize that the present invention may be alternatively employed in a vehicle having no rear doors. Moreover, the rear opening may be covered with a single panel that is connected to the vehicle body at one of its ends, one or more panels that connect to the body along a side, or the like. The audio system of the present invention may be equipped with any of a variety of common peripheral items and may be operated by remote control. The forward and rearward speakers of each speaker assembly may be the same type of speaker, or they may differ. For instance, one speaker in each assembly may be capable of delivering frequencies within a higher range, with the other capable delivering sound within a lower range. The speakers may be part of a system including additional speakers (e.g., ten total speakers). Other variations may also be made to the system performance by assuring, in accordance with the invention, that direct sound waves can be dispersed through the rear opening (when open) and off-axis reflections from side glass and trim combine to enhance the sound quality through the combination of direct and reflected waves when the rear opening is closed.

What is claimed is:

1. An audio system for projecting sound toward a rear portion of an automotive vehicle, comprising:

an automotive vehicle body having a first side and a second side, each being spaced opposite the other about a longitudinal axis of said body, and a rear opening;

at least one side door on each side of said body;

at least one panel hingedly connected to said body for permitting passage through and sealing said rear opening;

a first speaker assembly mounted to an interior wall of said first side between said side door on said first side and said rear opening and including a first speaker housing containing a first forwardly disposed speaker cone with an axis generally perpendicular to said first side and a first rearwardly disposed speaker cone with an axis disposed toward said rear opening at an angle of about 15 degrees relative to said first forwardly disposed speaker cone axis; and a second speaker assembly mounted to an interior wall of said second side between said side door on said second side and said rear opening, and opposite said first speaker assembly, including a second speaker housing containing a second forwardly disposed speaker cone with an axis generally perpendicular to said second side and a second rearwardly disposed speaker cone with an axis disposed toward said rear opening at an angle of about 15 degrees relative to said second forwardly disposed speaker cone axis; and an audio transmitter in signaling communication with each of said speaker cones for driving said speaker cones.

2. An audio system as in claim 1, further comprising a second panel hingedly connected to said body for cooperatively permitting passage through and sealing said rear opening together with said at least one panel.

3. An audio system as in claim 1, wherein said first housing includes a first enclosure physically separated from a second enclosure, said first enclosure for receiving said first forwardly disposed speaker cone, said second enclosure for receiving said first rearwardly disposed speaker cone and said second housing includes a third enclosure physically separated from a fourth enclosure, said third enclosure for receiving said second forwardly disposed speaker cone, said fourth enclosure for receiving said second rearwardly disposed speaker cone.

4. An audio system as in claim 1, wherein said first housing and said second housing each include an acoustical port including a first annular portion received within and spaced apart from a second annular portion.

5. An audio system as in claim 1, wherein said cones are capable of delivering direct sound waves through all of said rear opening when said rear opening is in an open position.

6. An audio system for projecting sound toward a rear portion of an automotive vehicle, comprising:

an automotive vehicle body having a first side and a second side, each being spaced opposite the other about a longitudinal axis of said body, and a rear opening;

a front and a rear side door on each side of said body;

a first rear door hingedly connected at an upper edge to said body;

a second rear door hingedly connected at a lower edge to said body; said first and second rear doors each having a free end that sealingly engages the free end of the other door when said first and second rear doors are in their closed positions;

a first speaker assembly mounted to said first side between said rear side door on said first side and said rear opening and including a first speaker housing having a first wall, said first wall having a first forward aperture and a first sloping wall portion with a first rearward aperture, said first assembly further including a first forwardly disposed speaker cone opening about an axis generally perpendicular to said first side and disposed in said first forward aperture, and a first rearwardly disposed speaker cone disposed about an axis at angle of about 15 degrees relative to said first forwardly disposed speaker cone axis and disposed in said first rearwardly disposed aperture; and a second speaker assembly mounted to said second side between said rear side door on said second side and said rear opening and including a second speaker housing having a second wall, said second wall having a second forward aperture and a second sloping wall portion with a second rearward aperture, said second assembly further including a second forwardly disposed speaker cone opening about an axis generally perpendicular to said second side and disposed in said second forward aperture, and a second rearwardly disposed speaker cone disposed about an axis at angle of about 15 degrees relative to said second forwardly disposed speaker cone axis and disposed in said second rearwardly disposed aperture; and an audio transmitter in signaling communication with each of said speaker cones for driving said speaker cones.

7. An audio system as in claim 6, wherein said first housing includes a first enclosure physically separated from a second enclosure, said first enclosure for receiving said first forwardly disposed speaker cone, said second enclosure for receiving said first rearwardly disposed speaker cone and said second housing includes a third enclosure physically separated from a fourth enclosure, said third enclosure for receiving said second forwardly disposed speaker cone, said fourth enclosure for receiving said second rearwardly disposed speaker cone.

8. An audio system as in claim 6, wherein said first housing and said second housing each include an acoustical port including a first annular portion received within and spaced apart from a second annular portion.

9. An audio system as in claim 6, wherein said cones are capable of delivering direct sound waves through all of said rear opening when said rear opening is in an open position.

10. An audio system for projecting sound toward a rear portion of an automotive vehicle, comprising:

an automotive vehicle body defining a passenger portion and a contiguous cargo portion, said vehicle body having a first side and a second side, each being spaced opposite the other about a longitudinal axis of said body and a rear opening;

a front and a rear side door on each side of said body;

a first rear door hingedly connected at an upper edge to said body;

a second rear door hingedly connected at a lower edge to said body; said first and second rear doors each having a free end that sealingly engages the free end of the other door when said first and second rear doors are in their closed positions;

a first speaker assembly mounted to said first side between said rear side door on said first side and said rear opening, in said cargo portion and adjacent a wheel well of said vehicle, said first speaker assembly including a first molded plastic speaker housing having a first shell portion and an opposing second shell portion, said first shell portion having a first planar wall with a first forward aperture and a first sloping wall portion with a first rearward disposed aperture, said first assembly further including a first forwardly disposed speaker cone opening about an axis generally perpendicular to said first side and disposed in said first forward aperture, and a first rearwardly disposed speaker cone disposed about an axis at angle of about 15 degrees relative to said first forwardly disposed speaker cone axis and disposed in said first rearwardly disposed aperture; and a second speaker assembly mounted to said second side between said rear side door on said second side and said rear opening, in said cargo portion and adjacent another wheel well of said vehicle, said second speaker assembly including a second molded plastic speaker housing having a third shell portion opposing a fourth shell portion, said third shell portion having a second planar wall with a second forward aperture and a second sloping wall portion with a second rearward disposed aperture, said second assembly further including a second forwardly disposed speaker cone opening about an axis generally perpendicular to said second side and disposed in said second forward aperture, and a second rearwardly disposed speaker cone disposed about an axis at angle of about 15 degrees relative to said second forwardly disposed speaker cone axis and disposed in said second rearwardly disposed aperture; and an audio transmitter in signaling communication with each of said speaker cones for driving said speaker cones.

11. An audio system as in claim 10, further comprising a first gasket disposed between said first and second shell portions and a second gasket disposed between said third and fourth shell portions.

* * * * *